US005810302A

United States Patent [19]

McCance

[11] Patent Number: 5,810,302

[45] Date of Patent: Sep. 22, 1998

[54] CURTAIN ROD ASSEMBLY

[76] Inventor: Patrick M. McCance, 6100 Armor Pl., Powder Springs, Ga. 30073

[21] Appl. No.: 771,224

[22] Filed: Dec. 20, 1996

[51] Int. Cl.[6] ..... E04G 25/00

[52] U.S. Cl. ..... 248/200.1; 248/256; 248/265; 248/271

[58] Field of Search ..... 248/200.1, 255, 248/256, 259, 260, 261, 265, 266, 268, 269, 271; 211/87, 105.1, 105.5, 105.6

[56] References Cited

U.S. PATENT DOCUMENTS

| | | | |
|---|---|---|---|
| 1,435,613 | 11/1922 | Miller | 248/252 |
| 2,268,362 | 12/1941 | Weber | 248/256 |
| 2,449,597 | 9/1948 | Ferrenberg | 248/252 |
| 2,474,434 | 6/1949 | Mentz | 248/252 |
| 2,518,610 | 8/1950 | Frank, Sr. et al. | 248/252 |
| 2,647,644 | 8/1953 | Cieslik | 211/105.6 |
| 3,889,912 | 6/1975 | Ray | 248/269 |
| 4,744,471 | 5/1988 | Leister | 211/105.6 |

*Primary Examiner*—Ramon O. Ramirez
*Assistant Examiner*—Anita M. King
*Attorney, Agent, or Firm*—Joseph N. Breaux

[57] ABSTRACT

An assembly for mounting a curtain rod to a window frame that includes an adjustable length compression rod having first and second opposed ends each having a gripping pad secured thereto, the adjustable length rod having a force mechanism for forcing the first and second opposed ends away from each other in a manner such that the gripping pads contact and exert a force between two opposed window jam surfaces to support the adjustable length compression rod therebetween and prevent rotation of the adjustable length compression rod while thus supported; a curtain rod having an elongated curtain support portion terminating at a first curtain rod end thereof in connection with a first wall contact portion and terminating at a second curtain rod end thereof in connection with a second wall contact portion; and a rigid connecting rod rigidly affixable to the adjustable length compression rod at a first connecting rod end thereof and rigidly affixable to the curtain support portion of the curtain rod at a second connecting rod end thereof, the connecting rod being of a length such that when said adjustable length rod is positioned between opposed window jam surfaces and the first and second wall contact portions of the curtain the second connecting rod end is positioned outside of and above the window jam.

14 Claims, 4 Drawing Sheets

CURTAIN ROD ASSEMBLY

TECHNICAL FIELD

The present invention relates to rods for supporting draperies, curtains and the like adjacent to a window and more particularly to an easily mounted curtain rod assembly that is mounted to a window with a compression rod positioned between opposed jam surfaces in the window jam assembly of the window. The curtain rod assembly includes a curtain rod for supporting curtains, draperies, valances and other window treatments. The curtain rod is attached to the compression rod by a rigid connecting rod that extends out and over the window jam when the compression rod is secured in place. In addition, if desired, a valance rod can be secured to the curtain rod to provide hanging structures for curtains and a valance.

BACKGROUND OF THE INVENTION

Conventional window treatments such as curtains, draperies, valances, and the like typically require support hardware such as a curtain rod to be mounted above the window jam of the window to be decorated. The curtain rod is generally permanently installed by screwing curtain rod brackets to the wall studs. It is important to secure the curtain rod brackets to these wall studs so that sufficient anchoring support is provided to support the weight of the window treatment. However, many people find locating these wall studs and screwing the curtain rod brackets into them difficult and time consuming. As a result, many people find it difficult and time consuming to properly install curtain rods.

It would be a benefit, therefore, to have a curtain rod assembly that was easily and quickly installed. Because many people rent, it would be a further benefit to have a curtain rod assembly that was easily removed and that did not damage the structure to which it was attached.

SUMMARY OF THE INVENTION

It is thus an object of the invention to provide a curtain rod assembly that is easily and quickly installed.

It is a further object of the invention to provide a curtain rod assembly that can be installed and removed without damaging the structure to which it is attached.

It is a further object of the invention to provide a curtain rod assembly that includes a valance rod and a curtain rod.

It is a further object of the invention to provide a curtain rod assembly that can be used to support blinds and shades in addition to a valance or curtain.

It is a still further object of the invention to provide a curtain rod assembly that accomplishes all or some the above objects in combination.

Accordingly, a curtain rod assembly is provided. The curtain rod assembly comprises an adjustable length compression rod having first and second opposed ends each having a gripping pad secured thereto, the adjustable length rod having a force mechanism for forcing the first and second opposed ends away from each other in a manner such that the gripping pads contact and exert a force between two opposed window jam surfaces to support the adjustable length compression rod therebetween and prevent rotation of the adjustable length compression rod while thus supported; a curtain rod having an elongated curtain support portion terminating at a first curtain rod end thereof in connection with a first wall contact portion and terminating at a second curtain rod end thereof in connection with a second wall contact portion; and a rigid connecting rod rigidly affixable to the adjustable length compression rod at a first connecting rod end thereof and rigidly affixable to the curtain support portion of the curtain rod at a second connecting rod end thereof, the connecting rod being of a length such that when the adjustable length compression rod is positioned between opposed window jam surfaces, the first and second wall contact portions of the curtain rod are positioned outside of and above the window jam.

In a preferred embodiment the curtain rod assembly is provided with a valance rod rigidly affixable to the curtain rod with a valance connecting rod. In another preferred embodiment the adjustable length compression rod is provided with a pair of attachment apertures at each end thereof for connecting with a blind assembly or a shade assembly having a pair of spaced, resilient right angled mounting clips. This allows the adjustable length rod to be used to support either a shade assembly or a blind assembly when desired. In addition, to provide flexibility to the end user, it is also preferred to provided detachable connecting rods, such as with friction fit ends, to allow the curtain and valance rods to be used as desired.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

DESCRIPTION OF THE EXEMPLARY EMBODIMENT

Figure 1:
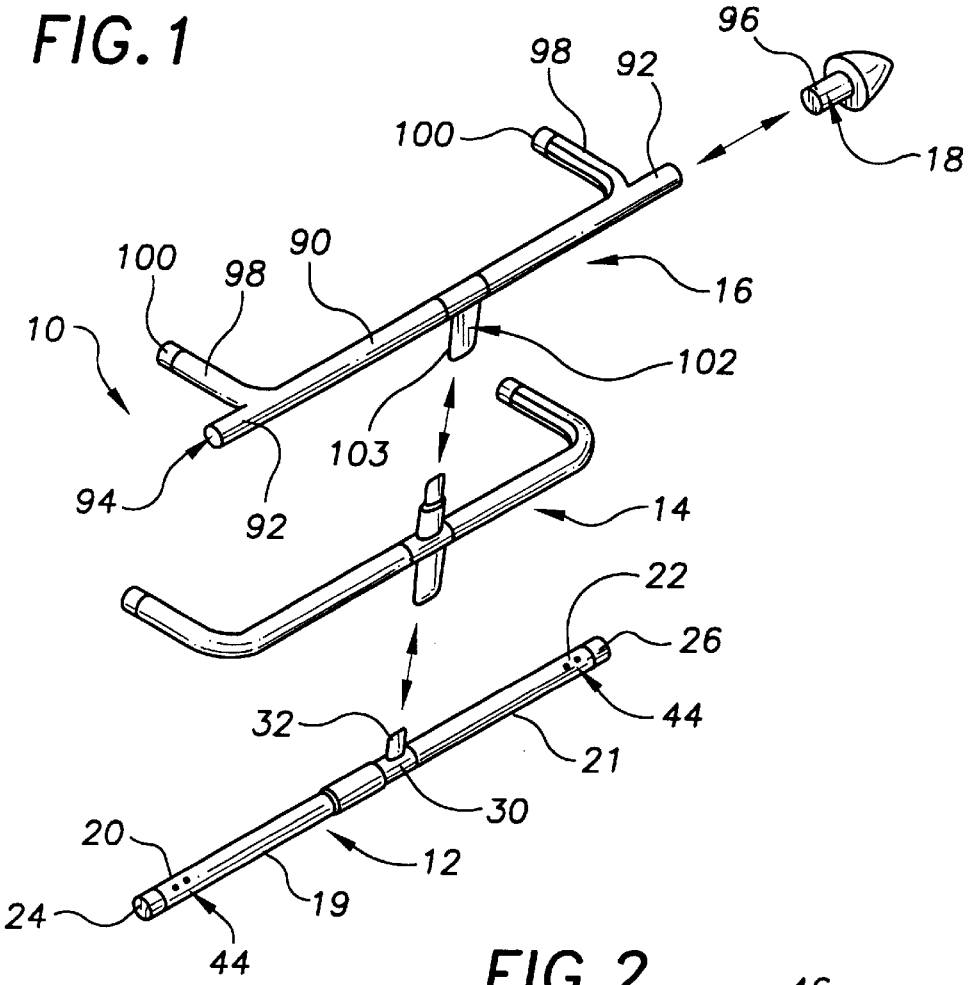
FIG. 1 is a perspective view of a first exemplary embodiment of the curtain rod assembly of the present invention showing the adjustable length compression rod including the first and second gripping pads; the curtain rod including the curtain support portion, the first wall contact portion, and the second wall contact portion; the valance rod with the valance wall contact portions and the finial attachment projections; and the detachable rigid connecting rod mechanisms for rigidly affixing the curtain rod to the adjustable length compression rod and the valance rod to the curtain rod.

FIG. 1 shows a first exemplary embodiment of the curtain rod assembly of the present invention generally designated by the numeral 10. Curtain rod assembly 10 includes an adjustable length compression rod, generally designated 12; a curtain rod, generally designated 14; a valance rod, generally designated 16, including a pair of finial ends 18 (only one shown).

Figure 5:
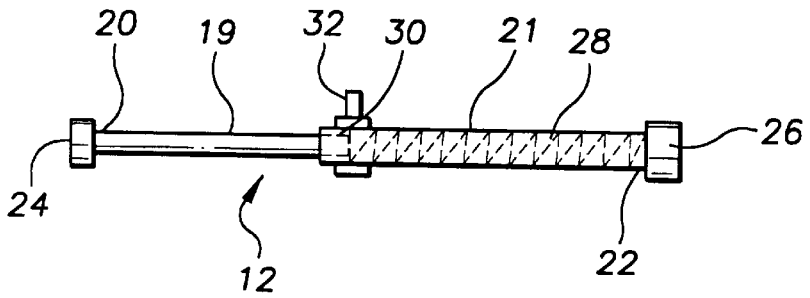
FIG. 5 is a cross sectional view of an exemplary embodiment of the adjustable length rod that is spring loaded showing the two slidably connected rods, the spring, the first and second gripping pads, and the compression rod connecting fitting.
Figure 5A:
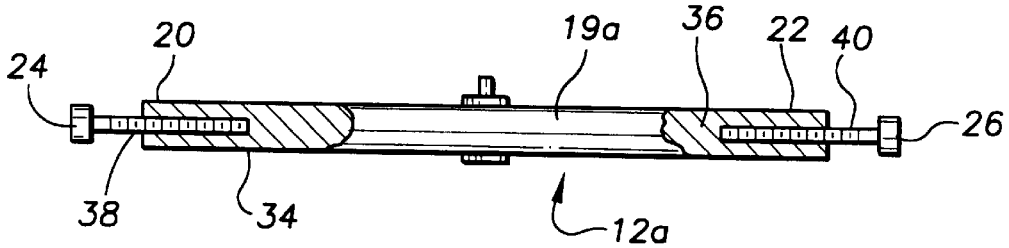
FIG. 5A is a cross sectional view of a second exemplary embodiment of the adjustable length rod that is screw adjustable showing the two oppositely threaded screw receiving bores, the two oppositely threaded screw members, the first and second gripping pads, and the compression rod connecting fitting.

In this embodiment, adjustable length compression rod 12 is constructed from a first and second length 19, 21 of metal tubing having first and second opposed ends 20, 22. With reference to FIG. 5, first length of metal tubing 19 is slidably mounted within second length of metal tubing 21. A gripping pad 24, 26 is secured to each opposed end 20, 22. A spring 28 is provided within second length of metal tubing 21 to provide a force mechanism for forcing first and second opposed ends 20, 22 away from each other in a manner such that gripping pads 24, 26 contact and exert a force between two opposed window jam surfaces of the window assembly of sufficient magnitude to support adjustable length compression rod 12 therebetween and prevent rotation of adjustable length compression rod 12 while thus supported. A compression rod extension fitting 30 is provided on second length of metal tubing 21 that comprises a rectangular cross-section attachment protrusion 32. FIG. 5A shows a second exemplary adjustable length compression rod 12*a* constructed from one length of metal tubing 19*a* having opposed side ends 20, 22. Each opposed side end 20, 22 is provided with a screw bore 34, 36. Screw bore 34 is threaded opposite screw bore 36. A first screw member 38 is companionately threaded with screw bore 34 and a second screw member 40 is companionately threaded with second screw bore 36. A gripping pad 24, 26 is provided at the end of each screw member 38, 40, respectively.

Figure 2:
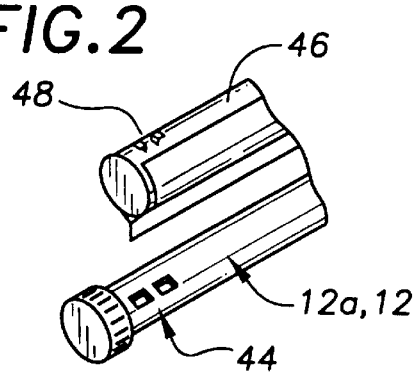
FIG. 2 is a partial perspective view of one end of the adjustable length compression rod showing one of the gripping pads and one of the two pairs of spaced, rectangular shade/blind attachment holes; and a partial perspective view of a shade assembly having two pairs of spaced resilient right angled mounting clips sized to fit and lock within the shade/blind attachment holes (only one pair of mounting clips and attachment holes shown).
Figure 2A:
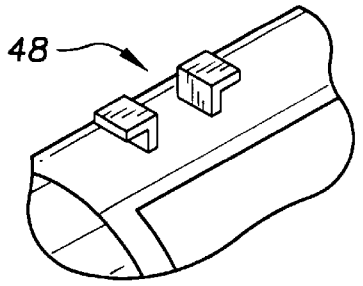
FIG. 2A is a detail perspective view of one end of the shade assembly of FIG. 2 showing one pair of spaced resilient right angled mounting clips.

Referring now to FIG. 2, each adjustable length compression rod 12, 12*a* is provided with two pairs of spaced, rectangular shade/blind attachment holes 44 (only one pair shown). Shade/blind attachment holes 44 are provided to allow connection of a shade assembly 46 having two pairs of spaced resilient right angled mounting clips 48 (only one pair shown) sized to fit and lock within shade/blind attachment holes 44 and thereby secure shade assembly 46 to adjustable length compression rod 12*a*, 12 if desired. With reference to FIG. 2A, spaced resilient right angled mounting clips 48 are forced together during insertion into shade/blind attachment holes 44 and resiliently spring back to a locking position after passing through shade/blind attachment holes 44.

Figure 3:
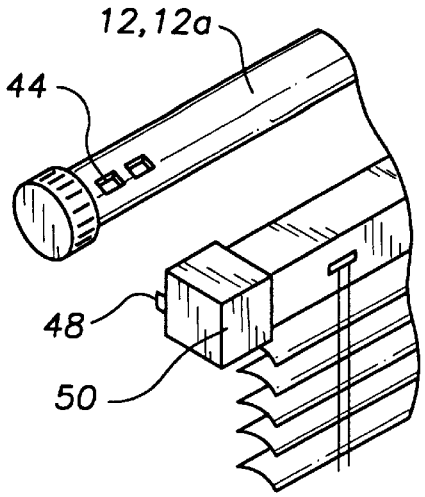
FIG. 3 is a partial perspective view of one end of the adjustable length compression rod showing one of the gripping pads and one of the two pairs of spaced, rectangular shade/blind attachment holes; and a partial perspective view of a blind assembly having two pairs of spaced resilient right angled mounting clips sized to fit and lock within the shade/blind attachment holes (only one pair of mounting clips and attachment holes shown).
Figure 3A:
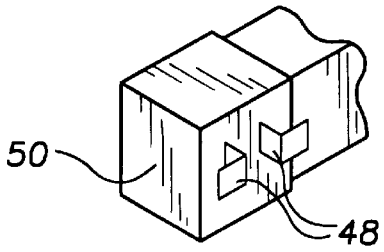
FIG. 3A is a detail perspective view of one end of the blind assembly of FIG. 3 showing one pair of spaced resilient right angled mounting clips.

Similarly, with reference to FIG. 3, a blind assembly 50 having two pairs of spaced right angled mounting clips 48 (only one pair shown) can also be attached to adjustable compression rod 12*a*, 12 using shade/blind attachment holes 44 (only one pair shown). As shown in FIG. 3A, right angled mounting clips 48 are provided on each end of blind assembly 50.

Figure 4:
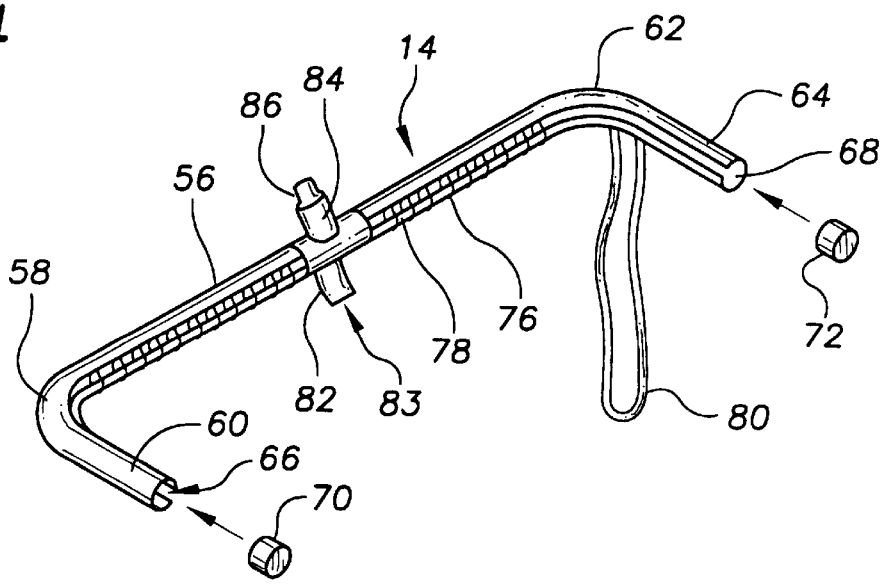
FIG. 4 is a perspective view of the curtain rod of FIG. 1 showing the compression rod connecting rod fitting, the valance rod connecting rod fitting, the curtain pull installed within a channel provided within the curtain support portion, and the two removable wall contact bumpers shown exploded from the wall contact portions.

With reference to FIG. 4, curtain rod 14 is constructed from metal and includes an elongated curtain support portion 56 terminating at a first curtain rod end 58 in integral connection with a first wall contact portion 60 and terminating at a second curtain rod end 62 in integral connection with a second wall contact portion 64. Each first and second curtain rod end 60, 64 is provided with a wall contact bumper receiving port 66, 68 into which a resilient plastic wall contact bumper 70, 72 is inserted.

In addition, elongated curtain support portion 56 is provided with a curtain pull mechanism 76 having a number of curtain attachment loops 78 that are attachable to a curtain and a drawstring 80 that is hooked to curtain attachment loops 78 in a manner to draw a curtain attached thereto open or closed as desired by manipulating the drawstring 80. A curtain rod connecting fitting 82 extends from a center of curtain support portion 56 at an angle of about forty-five degrees with respect to first and second wall contact portions 60, 64. Although a forty-five degree angle is used in this exemplary embodiment, the angle need only be sufficient to allow the curtain rod assembly to extend out of and past the window frame when the adjustable length compression rod is installed between two opposed surfaces of the window frame. Curtain rod connecting fitting 82 is provided with a rectangular shaped cross-sectional aperture 83 adapted for frictionally receiving and rigidly holding attachment protrusion 32 of compression rod connecting fitting 30. A valance attachment fitting 84 having a valance attachment protrusion 86 extends from the opposite side of curtain support portion 56. Valance attachment protrusion 86 is aligned substantially collinearly with curtain rod connecting fitting 82. With reference once again to FIG. 1, valance rod 16 is constructed from metal tubing and includes a substantially straight valance support portion 90 that terminates at either end thereof in finial attachment projections 92. Each finial attachment projection 92 includes a finial receiving aperture 94 into which the plug end 96 of a finial 18 is inserted and held during installation. A valance wall contact portion 98 curve outwardly from each valance support portion 90 and terminates in a wall contact pad 100. A valance connecting rod 102 extends outwardly from the center of valance support portion 90 at an angle of about forty-five degrees with respect to wall contact portions 98. Although a forty-five degree angle is used in this exemplary embodiment, the angle need only be sufficient to allow the valance rod to be positioned above the curtain rod when the curtain rod is in position above the window frame and the adjustable length compression rod is installed between two opposed surfaces of the window frame. The angle between the curtain rod and the connecting rod is preferably between 25 and seventy-five degrees. The end of valance connecting rod 102 is provided with a valance protrusion connecting aperture 103 sized to receive and rigidly hold valance attachment protrusion 86 of valance connecting fitting 84.

Figure 6:
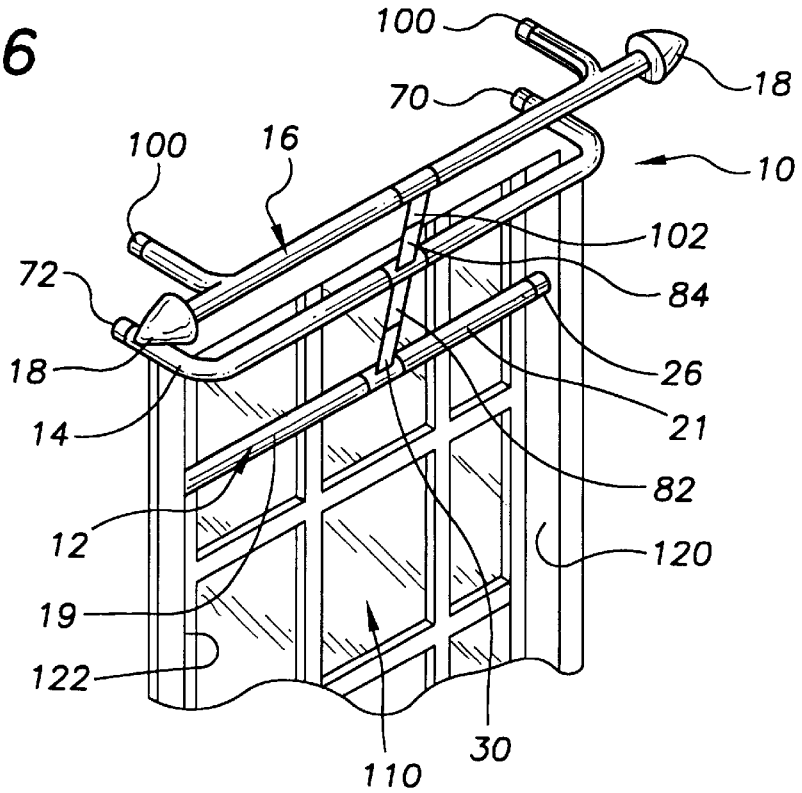
FIG. 6 is a perspective view of the first exemplary curtain rod assembly of FIG. 1 installed in a representative window with a window frame.

FIG. 6 shows curtain rod assembly 10 installed in connection with a representative window unit 110. Curtain rod assembly 10 is assembled by connecting curtain rod 14 to adjustable length compression rod 12 by inserting attachment protrusion 32 of compression rod connecting fitting 30 into aperture 83 of curtain rod connecting fitting 82 and connecting valance rod 16 to curtain rod 14 by inserting valance attachment protrusion 86 of valance connecting fitting 84 into receiving aperture 103 of valance connecting rod 102. Once curtain rod assembly 10 is assembled, curtain rod assembly 10 is installed by compressing first length of metal tubing 19 and second length of metal tubing 21 together until gripping pads 24, 26 (gripping pad 24 shown in FIG. 1) are spaced a distance apart less than the distance between vertical window frame members 120, 122. Adjustable length compression rod 12 is then placed between vertical window frame members 120, 122 and curtain rod assembly 10 positioned until wall contact bumpers 70, 72 of curtain rod 14 and wall contact pads 100 of valance rod 16 are in contact with the wall positioned above window assembly 110. Once the wall contact bumpers 70, 72 and the wall contact pads 100 are in contact with the wall, first length of metal tubing 19 and second length of metal tubing 21 are released allowing spring 28 to force gripping pads 24, 26 against vertical window frame members 120, 122. The spring constant of spring 28 is selected to provide sufficient force to maintain adjustable length compression rod 12 in place and prevent rotation of compression rod 12 when supporting a curtain and a valance on curtain rod 14 and valance rod 16, respectively.

Figure 7:
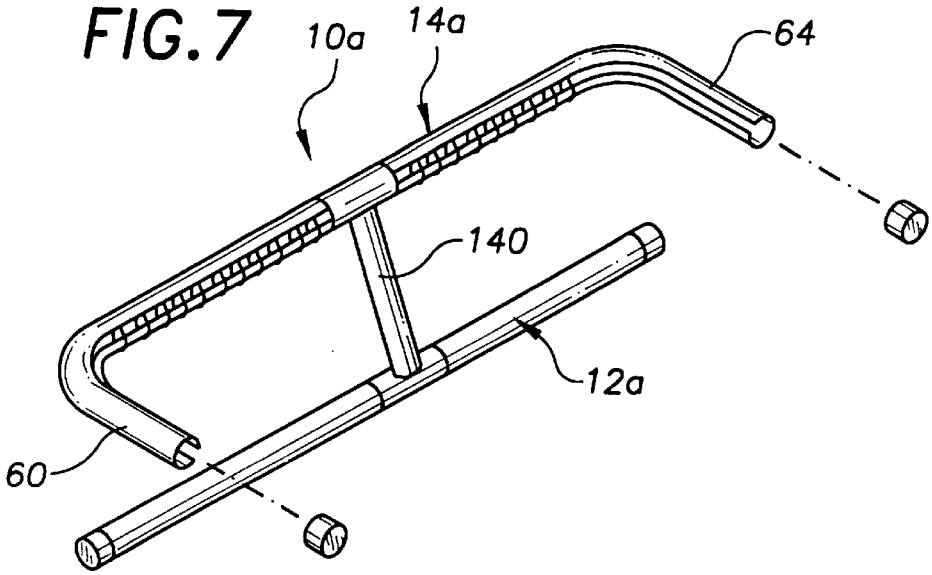
FIG. 7 is a perspective view of a second exemplary curtain rod assembly of the present invention showing a unitary assembly including the adjustable length compression rod, the curtain rod, and the connecting rod permanently affixed between the compression rod and the curtain rod.
Figure 8:
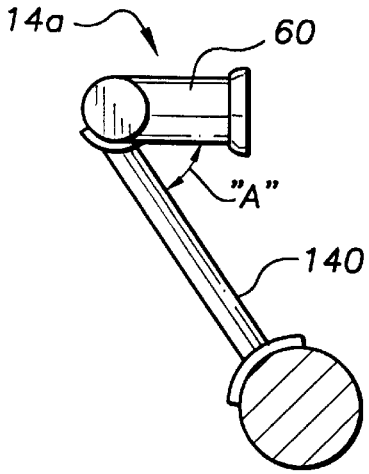
FIG. 8 is a side view of the exemplary curtain rod assembly of FIG. 7 showing one of the wall contact portions, one of the gripping pads, and the connecting rod rigidly affixed between the curtain rod and the compression rod at a forty-five degree angle.
Figure 9:
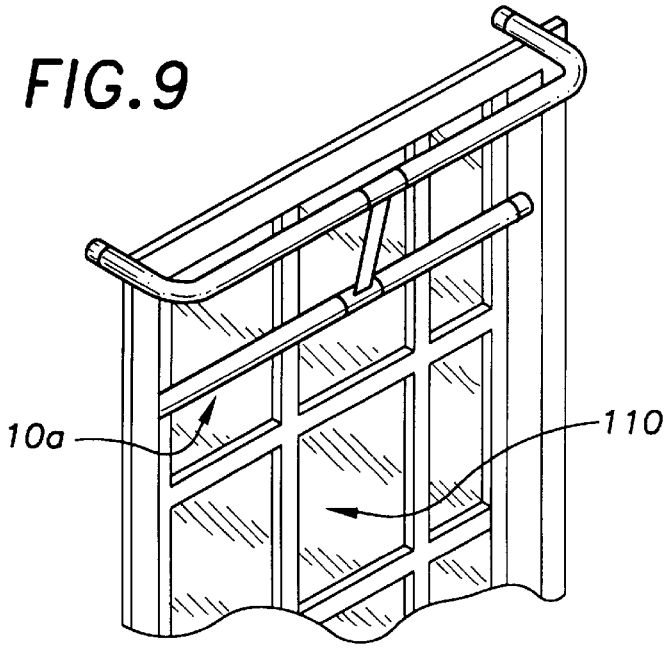
FIG. 9 is a perspective view of the curtain rod assembly of FIG. 7 installed in a representative window assembly including a window frame.

A second exemplary embodiment of the curtain rod assembly of the present invention is shown in FIG. 7 and generally designated by the numeral 10*a*. In this embodiment, curtain rod assembly 10*a* includes a spring loaded, elongated compression rod 12*a* and a curtain rod 14*a* identical to compression rod 12 and curtain rod 14 except that a connecting rod 140 is permanently affixed between compression rod 12*a* and curtain rod 14*a*. With reference to FIG. 8, connecting rod 140 is constructed of metal tubing and is oriented at an angle "A" of forty-five degrees with respect to wall contact portions 60, 64 of curtain rod 14*a*. FIG. 9 shows curtain rod assembly 10*a* in use in representative window assembly 110. Curtain rod assembly 10*a* is installed identically to curtain rod assembly 10. As before, although a forty-five degree angle is used in this exemplary embodiment, the angle need only be sufficient to allow the curtain rod assembly to extend out of and past the window frame when the adjustable length compression rod is installed between two opposed surfaces of the window frame.

It can be seen from the preceding description that a curtain rod assembly has been provided that easily and quickly installed; that can be installed and removed without damaging the structure to which it was attached; that includes a valance rod and a curtain rod; and that can be used to support blinds and shades in addition to a valance or curtain.

It is noted that the embodiment of the curtain rod assembly described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A curtain rod assembly comprising:

an adjustable length compression rod having first and second opposed ends each having a gripping pad secured thereto, said adjustable length rod having a force mechanism for forcing said first and second opposed ends away from each other in a manner such that said gripping pads contact and exert a force between two opposed window jam surfaces to support said adjustable length compression rod therebetween and prevent rotation of said adjustable length compression rod while thus supported;

a curtain rod having an elongated curtain support portion terminating at a first curtain rod end thereof in connection with a first wall contact portion and terminating at a second curtain rod end thereof in connection with a second wall contact portion; and a rigid connecting rod rigidly affixable to said adjustable length compression rod at a first connecting rod end thereof and rigidly affixable to said curtain support portion of said curtain rod at a second connecting rod end thereof, said connecting rod being of a length such that when said adjustable length compression rod is positioned between opposed window jam surfaces, said first and second wall contact portions of said curtain rod are positioned outside of and above said window jam;

said adjustable length compression rod being provided with a pair of attachment apertures at each end thereof for connecting with a blind assembly or a shade assembly having a pair of spaced, resilient right angled mounting clips.

2. The curtain rod assembly of claim 1, wherein said curtain rod assembly further includes:

a valance rod rigidly affixable to said curtain rod with a valance connecting rod.

3. The curtain rod assembly of claim 2 wherein:

said connecting rod is detachable from said curtain rod.

4. The curtain rod assembly of claim 3 wherein:

said connecting rod includes a compression rod extension fitting secured to said adjustable length compression rod and a curtain rod connecting fitting extends from said curtain support portion at an angle of between twenty-five and eighty degrees with respect to said wall contact portions;

said compression rod extension fitting and said curtain rod connecting fitting being attachable together in a manner to form a rigid connection between said curtain rod and said adjustable length compression rod.

5. The curtain rod assembly of claim 2 wherein:

said curtain rod includes a valance attachment fitting;

and said curtain rod assembly further includes a valance rod including a valance support portion, said valance rod further including a valance connecting rod extending outwardly from said valance support portion;

said valance connecting rod being detachably securable to said valance attachment fitting in a manner to provide a rigid attachment between said curtain rod and said valance rod.

6. The curtain rod assembly of claim 1 wherein:

said connecting rod is detachable from said curtain rod.

7. The curtain rod assembly of claim 6 wherein:

said connecting rod includes a compression rod extension fitting secured to said adjustable length compression rod and a curtain rod connecting fitting extends from said curtain support portion at an angle of between twenty-five and eighty degrees with respect to said wall contact portions;

said compression rod extension fitting and said curtain rod connecting fitting being attachable together in a manner to form a rigid connection between said curtain rod and said adjustable length compression rod.

8. The curtain rod assembly of claim 6 wherein:

said curtain rod includes a valance attachment fitting;

and said curtain rod assembly further includes a valance rod including a valance support portion, said valance rod further including a valance connecting rod extending outwardly from said valance support portion;

said valance connecting rod being detachably securable to said valance attachment fitting in a manner to provide a rigid attachment between said curtain rod and said valance rod.

9. The curtain rod assembly of claim 1 wherein:

said curtain rod includes a valance attachment fitting;

and said curtain rod assembly further includes a valance rod including a valance support portion, said valance rod further including a valance connecting rod extending outwardly from said valance support portion;

said valance connecting rod being detachably securable to said valance attachment fitting in a manner to provide a rigid attachment between said curtain rod and said valance rod.

10. A curtain rod assembly comprising:

an adjustable length compression rod having first and second opposed ends each having a gripping pad secured thereto, said adjustable length rod having a force mechanism for forcing said first and second opposed ends away from each other in a manner such that said gripping pads contact and exert a force between two opposed window jam surfaces to support said adjustable length compression rod therebetween and prevent rotation of said adjustable length compression rod while thus supported;

a curtain rod having an elongated curtain support portion terminating at a first curtain rod end thereof in connection with a first wall contact portion and terminating at a second curtain rod end thereof in connection with a second wall contact portion;

a rigid connecting rod rigidly affixable to said adjustable length compression rod at a first connecting rod end thereof and rigidly affixable to said curtain support portion of said curtain rod at a second connecting rod end thereof, said connecting rod being of a length such that when said adjustable length compression rod is positioned between opposed window jam surfaces, said first and second wall contact portions of said curtain rod are positioned outside of and above said window jam; and a valance rod rigidly affixable to said curtain rod with a valance connecting rod.

11. The curtain rod assembly of claim 10 wherein:

said connecting rod is detachable from said curtain rod.

12. The curtain rod assembly of claim 11 wherein:

said connecting rod includes a compression rod extension fitting secured to said adjustable length compression rod and a curtain rod connecting fitting extends from said curtain support portion at an angle of between twenty-five and eighty degrees with respect to said wall contact portions;

said compression rod extension fitting and said curtain rod connecting fitting being attachable together in a manner to form a rigid connection between said curtain rod and said adjustable length compression rod.

13. The curtain rod assembly of claim 11 wherein:

said curtain rod includes a valance attachment fitting;

and said curtain rod assembly further includes a valance rod including a valance support portion, said valance rod further including a valance connecting rod extending outwardly from said valance support portion;

said valance connecting rod being detachably securable to said valance attachment fitting in a manner to provide a rigid attachment between said curtain rod and said valance rod.

14. A curtain rod assembly comprising:

an adjustable length compression rod having first and second opposed ends each having a gripping pad secured thereto, said adjustable length rod having a force mechanism for forcing said first and second opposed ends away from each other in a manner such that said gripping pads contact and exert a force between two opposed window jam surfaces to support said adjustable length compression rod therebetween and prevent rotation of said adjustable length compression rod while thus supported;

a curtain rod having an elongated curtain support portion terminating at a first curtain rod end thereof in connection with a first wall contact portion and terminating at a second curtain rod end thereof in connection with a second wall contact portion; and a rigid connecting rod rigidly affixable to said adjustable length compression rod at a first connecting rod end thereof and rigidly affixable to said curtain support portion of said curtain rod at a second connecting rod end thereof, said connecting rod being of a length such that when said adjustable length compression rod is positioned between opposed window jam surfaces, said first and second wall contact portions of said curtain rod are positioned outside of and above said window jam;

said curtain rod including a valance attachment fitting;

and said curtain rod assembly further including a valance rod including a valance support portion, said valance rod further including a valance connecting rod extending outwardly from said valance support portion;

said valance connecting rod being detachably securable to said valance attachment fitting in a manner to provide a rigid attachment between said curtain rod and said valance rod.

* * * * *